United States Patent [19]

Knight

[11] 4,042,156

[45] Aug. 16, 1977

[54] TENNIS BALL HOLDER

[76] Inventor: Lynn E. Knight, 3726 Broderick St., San Francisco, Calif. 94123

[21] Appl. No.: 653,700

[22] Filed: Jan. 30, 1976

Related U.S. Application Data

[63] Continuation-in-part of Ser. No. 528,005, Nov. 29, 1974, abandoned.

[51] Int. Cl.[2] ..... B65D 85/00

[52] U.S. Cl. ..... 224/5 D; 206/315 B; 221/226; 221/279; 221/309

[58] Field of Search ..... 133/6; 206/315 B, 387; 220/93; 211/14; 224/5 D; 273/74; 221/309, 226, 279, 307

[56] References Cited

U.S. PATENT DOCUMENTS

| | | | |
|---|---|---|---|
| 1,414,875 | 5/1922 | Hanaford | 224/5 D |
| 1,718,952 | 7/1929 | Fischer | 206/315 B |
| 1,778,225 | 10/1930 | Morss | 224/5 D |
| 1,911,256 | 5/1933 | Andrew | 224/5 D |
| 2,548,330 | 4/1951 | Wiseman | 224/5 D |
| 2,665,571 | 1/1954 | Lochead | 211/14 |
| 2,708,061 | 5/1955 | Kotchka | 211/14 |
| 2,768,775 | 10/1956 | Houser | 206/315 B |
| 2,926,912 | 3/1960 | Gould | 273/74 |
| 2,950,748 | 8/1960 | Olinghouse | 206/315 B |
| 2,966,280 | 12/1960 | Nelson | 273/74 |
| 3,206,067 | 9/1965 | Smith, Jr. et al. | 206/315 B |
| 3,412,897 | 11/1968 | Slater | 221/309 |
| 3,613,871 | 10/1971 | Evans | 206/387 |
| 3,625,397 | 12/1971 | Shelly | 221/279 |
| 3,717,282 | 2/1973 | Nordskog | 220/93 |
| 3,721,447 | 3/1973 | Louderback | 206/315 B |
| 3,756,299 | 9/1973 | Simmons et al. | 206/315 B |
| 3,874,553 | 4/1975 | Schultz et al. | 220/273 |

FOREIGN PATENT DOCUMENTS

| | | | |
|---|---|---|---|
| 636,833 | 5/1950 | United Kingdom | 224/5 D |
| 326,425 | 3/1930 | United Kingdom | 224/5 D |

*Primary Examiner*—George E. Lowrance
*Assistant Examiner*—Allan N. Shoap
*Attorney, Agent, or Firm*—Townsend and Townsend

[57] ABSTRACT

An improved tennis ball carrier adapted to be carried on the person of a player comprises an axial structure divided into two axially aligned compartments and provided with a retaining lip at the mouth of each opposed open end, at least one side opening or means permitting fingers to access the mouth-opposing back side of an enclosed tennis ball and means for maintaining a snug hold on enclosed tennis balls under game playing conditions, but which still permits ready access to the back side of the ball. A belt or other clothing attachment may be provided permitting a player to harness the device to the body. A tennis ball held by the device may be released by applying finger pressure to the back side of the enclosed tennis ball compressing the ball sufficiently while urging it past the lip retaining it in the enclosure.

7 Claims, 15 Drawing Figures

FIG _ 1a
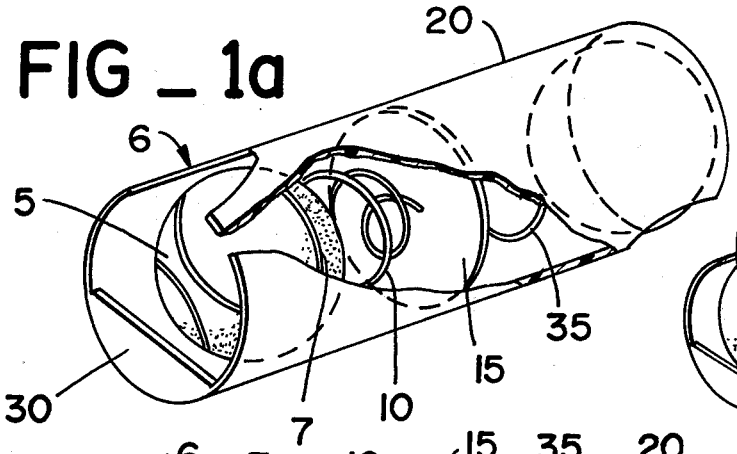
FIG _ 1b
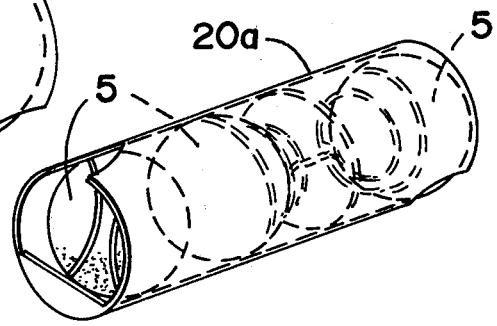
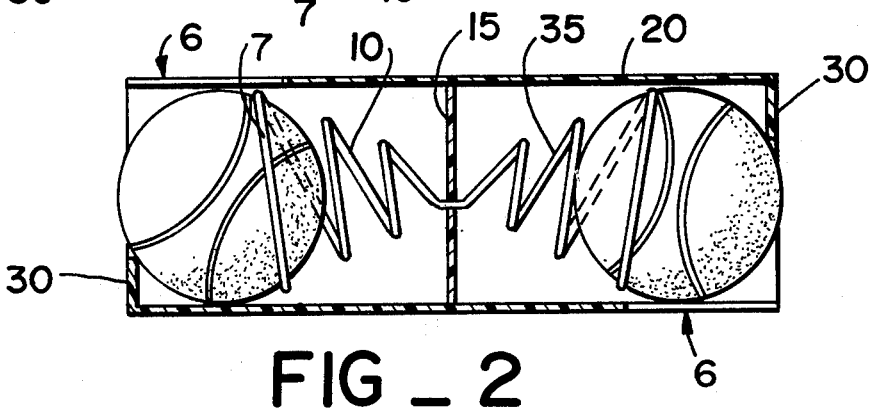
FIG _ 2
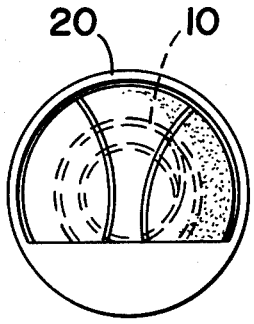
FIG _ 2a
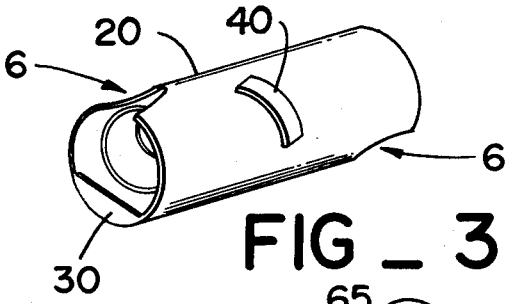
FIG _ 3
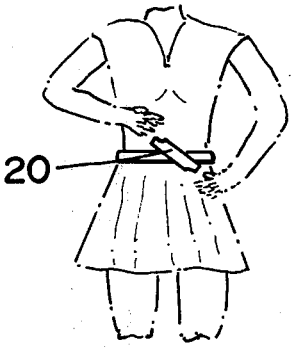
FIG _ 4
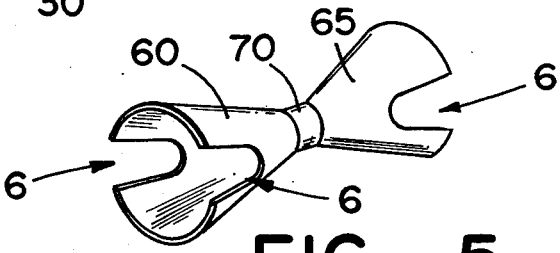
FIG _ 5
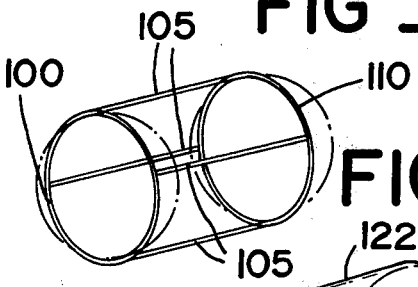
FIG _ 6
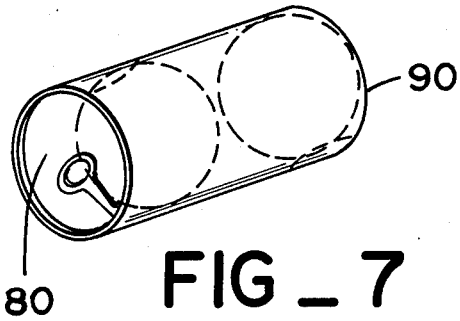
FIG _ 7
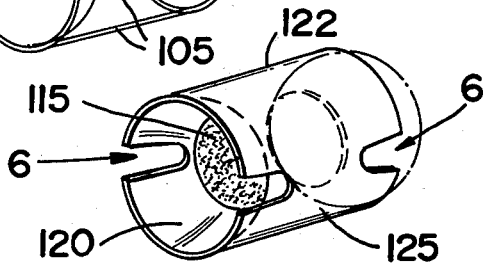
FIG _ 8

TENNIS BALL HOLDER

RELATED APPLICATION

This application is a continuation-in-part of U.S. patent application Ser. No. 528,005 filed Nov. 29, 1974, now abandoned.

BACKGROUND OF THE INVENTION

1. Field of the Invention

The present invention relates to tennis ball holders, and, more particularly, to tennis ball holders which may be worn on the person of a game participant. The present invention, though designed specifically for carrying tennis balls, may be readily adapted for use with any relatively pliant game ball without departing from the spirit and scope of the present invention.

Normally in the game of tennis, each player holds at least one extra ball during the service strokes. If the first service stroke has successfully entered the serivce box of the opposing court the server may be caught unprepared holding an extra ball. If there is a "let" ball, the server must have a third ball. In either case there is a disadvantage. In the first case the player is holding too many balls which may interfere with mobility and in the second case the player does not have ready access to further balls which may slow play.

For example, it is impossible to play two-handed tennis, wherein the left hand assists the right arm and/or the right hand assists the left arm in swinging the racket during the backhand stroke because one hand is occupied in holding one or more tennis balls.

As a further problem, many people having relatively small hands, such as some women and children, cannot hold two balls at one time during serve. The extra balls must therefore be placed upon the groung or be thrown in by a ball retriever.

In addition, most women's tennis outfits and many men's tennis pants and warm-up suits are seldom made with pockets, so extra tennis balls cannot readily or comfortably be carried by the player during service or play. Furthermore, if the extra tennis balls are set on the ground, as for example near the court base line, a danger exists that the player responding to a successful return may trip and fall on loose tennis balls, thereby resulting in injury.

2. Description of the Prior Art

Ball carriers and holders are known in the nature of cans, bags, pockets and boxes. For example, golf ball carriers are known comprising hollow tubular structures for carrying a column of hard balls wherein access openings in the side walls are normally smaller than enclosed balls, and wherein the walls are sufficiently pliant to permit an enclosed ball to pass through the openings. U.S. Pat. No. 3,756,299 exemplifies this structure. U.S. Pat. No. 3,717,282 discloses tubular dispensing structures employing springs biasing an enclosed article, such as a tennis or a golf ball adjacent an opening or mouth. These and other inventions include a flexible release or tongue which must deflect or flex to permit removal of the enclosed article.

Similarly British Patent Specification No. 636,833 teaches a holder for tennis balls comprising a length of stout resilient wire bent to define a pair of open loops joined by a connecting arm. The invention teaches means whereby a pair of tennis balls may firmly grip an article between the balls such as a racquet face.

In summary, the known prior art does not show or suggest a multiple-ball tubular tennis ball holder adapted to be attached to the person of a player permitting ready insertion and removal of an enclosed tennis ball, and particularly the known prior art does not show a tennis ball holder having substantially nondeformable mouth for retaining an enclosed tennis ball.

SUMMARY OF THE INVENTION

An improved tennis ball carrier adapted to be carried on the person of a player comprises an axial structure divided into two axially aligned compartments and provided with a retaining lip at the mouth of each opposed open end, at least one side opening or means permitting fingers to access the mouth-opposing back side of an enclosed tennis ball and means for maintaining a snut hold on enclosed tennis balls under game playing conditions but which still permits ready access to the back side of the ball. A belt or other clothing attachment may be provided permitting a player to harness the device to the body. A tennis ball held by the device may be released by applying finger pressure to the back side of the enclosed tennis ball thereby compressing the ball sufficiently while urging it past the lip retaining it in the enclosure.

More particularly, the present invention provides a tubular segmented housing for carrying game balls. Such housing may be made of rubber, plastic, mylar, or any other appropriate material. The housing is divided into chambers by a median wall. The chambers are closed at one end by the median wall and partially covered by a lip at the other end. Resilient members, such as springs, may be provided in each of the segments, so that when a tennis or other game ball is inserted into the partially open end of the segment, the spring will compress, and thereby bias the ball against the lip. Alternatively each tubular chamber may be provided with an axially and laterally deformable foam pad for maintaining a snug hold on an encountered ball. The lip may be made of plastic or any other substantially rigid material. The ball carrier may also be provided with a belt loop or snap for attachment to the apparel or person of the wearer in a convenient position for readily insertion and removal of game balls.

The present invention provides a carrier for game balls, particularly for tennis balls, which allows a player to carry such balls without restricting freedom of movement yet which firmly holds the ball in a position for easy removal and which permits quick reinsertion into the holder, thereby expediting play by minimizing time lost in ball retrieval.

Objects and Advantages of the Invention

It is an object of this invention to disclose a tennis ball carrier so designed as to permit ready insertion and removal of a tennis ball.

An advantage of this type of carrier is that it enables the player to carry two or three balls for use during serving, so that the player, particularly if small handed, does not need to carry two or three balls in one hand while serving or rallying.

A further advantage of the present invention is that it allows the tennis player's non-racket hand and arm to be free, especially for use in two-handed tennis.

An additional advantage of the present invention is that it prevents loose tennis balls from being left upon the court either by inadvertence or necessity, insofar as a player who is incapable of holding two tennis balls or carrying two or three balls on his or her person must otherwise set them on the ground.

Additionally, the present invention provides a means for carrying tennis balls while on the way to the tennis court in such a manner that a tennis ball canister, usually rather cumbersome to carry while riding a bicycle, is eliminated.

BRIEF DESCRIPTION OF THE DRAWINGS

The invention may best be understood by reference to the detailed description of preferred embodiments when in conjunction with the following figures, in which:

FIG. 1*a* is a perspective view showing one embodiment of the present invention, a tubular tennis ball carrier capable of holding and releasing two tennis balls;

FIG. 1*b* is a perspective view of an embodiment showing a tubular tennis ball carrier capable of carrying three balls;

FIG. 2 is a side elevational view of the game ball carrier embodiment shown in FIG. 1*a;*

FIG. 2*a* is an end elevational view of FIG. 2 looking outward from the cylinder of the carrier showing a spring partially holding and pressing up against the retaining lip of the device;

FIG. 3 shows the exterior of the holder of FIG. 2, with a belt loop mounted at an angle thereon for ready attachment to the belt of a player;

FIG. 4 shows a suitable position of attachment of the carrier of FIG. 3;

FIG. 5 is a perspective view of an alternative embodiment of the invention;

FIG. 6 is a perspective view of a further alternative embodiment of the invention, showing a pair of wire loops joined together by bars, so adapted to receive, hold, and release a pair of tennis balls;

FIG. 7 is a perspective of an alternative embodiment of the present invention, showing the device of FIG. 1*a* provided with two easy open lids for carrying the tennis balls in compressed state while in the carrier, for packaging and merchandising applications;

FIG. 8 is a perspective of an embodiment of the present invention, showing a tube having a pair of opposed cups, each for and retaining receiving a single tennis ball;

DETAILED DESCRIPTION OF THE PREFERRED EMBODIMENTS

Figure 9:
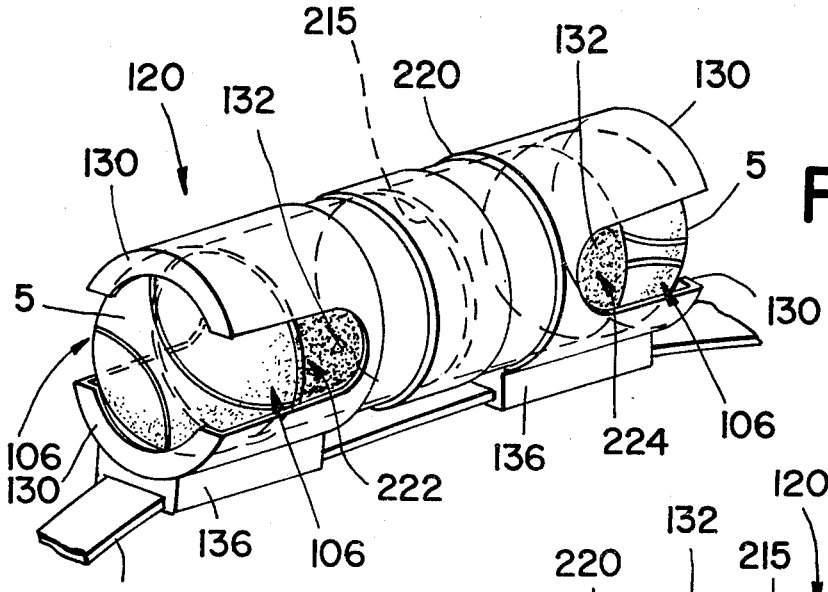
FIG. 9 is a perspective view of an embodiment of the present invention suitable for carrying two balls wherein foam pads assist in retaining enclosed tennis balls.

The present invention may be exemplified by a number of embodiments illustrating structure for holding tennis balls on the person of a player.

Referring specifically to FIG. 1*a,* a tennis ball carrier is shown which may be seen as generally comprising a tube 20, preferably fabricated from a rigid lightweight plastic, which has been segmented at its center by a circular bulkhead 15. Thus, it will be seen that tube 20 is divided into two discrete chambers. The bulkhead 15 anchors springs 10 and 35 in each of the chambers of tube 20. It will be seen that spring 10 has a loop 7 at the end opposite bulkhead 15 for cradling a tennis ball 5. Each end of tube 20 is open, and includes an inwardly protruding rigid substantially nondeformable lip 30 which partially covers the opening to tube 20. It will also be seen that each tube 20 includes an opening or slot 6 permitting digital, or finger, access to the back side of the enclosed tennis ball 5. The enclosed ball is removable from the chamber by grasping the ball, applying finger pressure compressing it slightly and urging it past the rigid lip 30. FIG. 1*b* shows an embodiment which will accomodate three balls in tandem. It differs from the embodiment of FIG. 1*a* in that the tube 20 is longer.

Referring more particularly to FIG. 2, the internal configuration of the tennis ball carrier may be viewed. It will be noted that the ends of springs 10 and 35, respectively, are anchored to bulkhead 15 in such a manner that expansion thrust pushes the ball firmly against lip 30 adjacent the open ends of the device.

Referring more particularly to FIG. 2*a,* it can be seen that spring 10 secures the ball so that it will not be inadvertently released from the chambers of the tube 20.

Referring more particularly to FIG. 3, the exterior of the tennis ball holder may be viewed. It will be noted that the tube includes an external belt loop 40 permitting a wearer to secure the carrier to a torso belt.

FIG. 4 illustrates the angle of affixation the carrier employing a tilted belt loop 40.

The carrier may be worn on a torso belt at an angle of approximately 45° with one end of the carrier pointing upwards toward one elbow of the wearer. Similarly, the opposite end of the carrier may point downward toward one elbow of the wearer. Similarly, the opposite end of the carrier may point downward toward the opposite hand of the wearer. In this orientation and position, the carrier allows easy insertion and removal of tennis balls from either end of the carrier.

Referring to FIG. 5, an alternate embodiment of the invention may be seen, comprising two truncated conical members 60 and 65, joined by a band 70. Truncated conical members 60 and 65 are preferably made of mylar, and the perimeter of the mouths is slightly smaller than the circumference of a tennis ball. Each conical member 60 or 65 includes side openings 6, preferably two opposed slots in each side. Thus, a tennis ball may be forced into the mouth of the member 60 or 65, wedging the ball within the conical interior. A wedged tennis ball may be removed from the cone by the player by grasping the sides and back of the wedge ball through the openings 6 and pulling it out.

Referring to FIG. 6, a further embodiment of the invention is depicted. The carrier comprises members 105, a pair of rings 100 and 110 joined together by a number of members 105. The rings 100 and 110 may be made of metal or plastic. Each ring should have an opening slightly smaller in circumference than the circumference of a tennis ball 5. A ball 5, may be carried by wedging it along its circumference in such ring. Ring compression will prevent it from slipping out unless pulled away from or pressed out of the ring by the player. One of the connecting members 105 may be used as a loop for affixing the device to the belt of the wearer. The members 105 connecting the rigid rings 100 and 110 may be, but need not be, rigid bars. In fact, cords or even a membrane may connect the rings 100 and 110, so long as tennis balls are either wedged in the rings 100 and 110 or removable only through the rigid rings. Furthermore, the connecting members may be shrouded by or comprise a portion of a pliant pouch forming a flexible enclosure tube terminating at the rings 100 and 110. A wedged or enclosed tennis ball is removable by pressing against the back side of the tennis ball, or the membrane adjacent the back side of the tennis ball, releasing it from or pressing it through the rigid rings 100 or 110.

FIG. 7 illustrates yet another embodiment of the present invention. FIG. 7 shows the carrier of FIG. 1*a* with a pair of easy-open type lids 80 and 90 closing either open end of the carrier. Thus, two tennis balls may be placed in the device, and the entire device may be placed under compression and sealed by easy-open tops 80 and 90 for packaging and sale.

FIG. 8 depicts a still further embodiment of the present invention, wherein a pair of cups 120 and 125 are disposed within a hollow tube 122. The cups 120 and 125 are preferably semispherical in shape and in dimension conform to slightly more than half the diameter of a tennis ball. In the bottom of the cups are placed pads of pile fabric adhesive 115 such as a Velcro hook pad. When a tennis ball is nested in each of the semispherical cups 120 and 125, the fabric adhesive 115 releasably attaches onto the fuzzy pile fabric exterior of the ball, preventing it from falling out of the cup 120 or 125 during play. It should be understood that such balls must have sufficient pile to permit pile fabric adhesive hooks to engage the pile.

Figure 10:
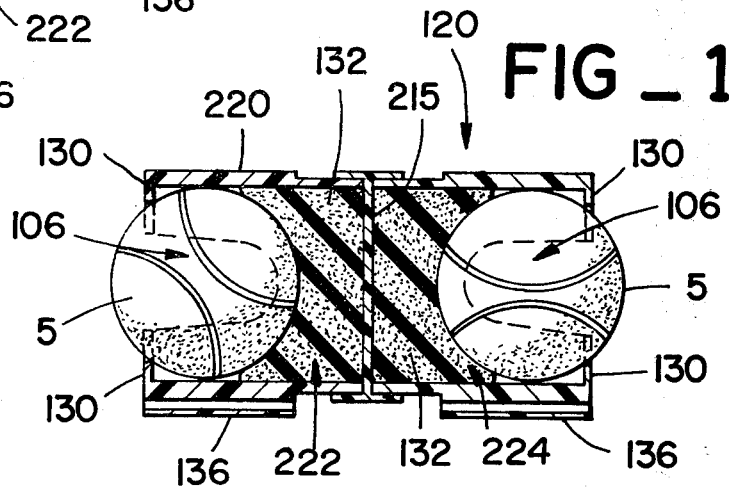
FIG. 10 is a cross-sectional view of the embodiment of FIG. 9.

FIGS. 9 and 10 show a further embodiment of the invention. A generally tubular structure 120 includes two open chambers 222 and 224 each of a size sufficient to enclose a single tennis ball 5. A partition 215 separates the two chamber 222 and 224, defining a pair of axially oriented side openings 106 disposed opposing one another adjacent the open ends or mouths. Each opening is sufficiently wide to permit a thumb or a finger to be inserted into the chamber, and longer axially than the radius of a tennis ball. A pair of generally circular lips 130 protrude inwardly along the margin of the open mouths, terminating at the side openings. The lips 130 define a circle smaller then the circumference of a standard tennis ball. However, the circle is not so small as to prevent removal of an enclosed tennis ball by hand compression applied to the tennis ball through the side opening 106. The material forming the tubular structure and the lip of this embodiment may be rigid and nondeformable. However, the material is preferably resilient, pliant and impact-resistant such as polyurethane plastic.

Enclosed within each chanber 222 and 224 is a cylindrically shaped compressible resilient foam pad 132. The pads 132 are each preferably of a thickness corresponding to at least one-half the diameter of a tennis ball, and when fully expanded, fill the chambers 222 and 224 to a volume leaving not more than the equivalent of about one-half tennis ball volume. Alternatively, the foam pads 132 in the fully expanded, or nondeformed state, may fill the chambers to a level less than about one ball radius from the lip 130. Belt loops 136 and a belt 138 are provided for attachment of the ball carrier to the person.

In use, the chamber 222 receives a ball through the open mouth causing the pad 132 to compress and substantially conform to the confronting surface of the ball and to releasably maintain the ball in contact with the circular lips 130. The frictional contact between the pad and the enclosed ball hinder rotation of the ball within the enclosure and prevent it from bouncing around during user movement. To remove a ball, the user may insert the thumb or one or two fingers into the opposing side openings laterally displacing or deforming the foam pad to obtain a grip on the ball. The pad is sufficiently deep and pliant so as to permit ready finger access without interference to the pad-confronting side of the enclosed ball.

Figure 11:
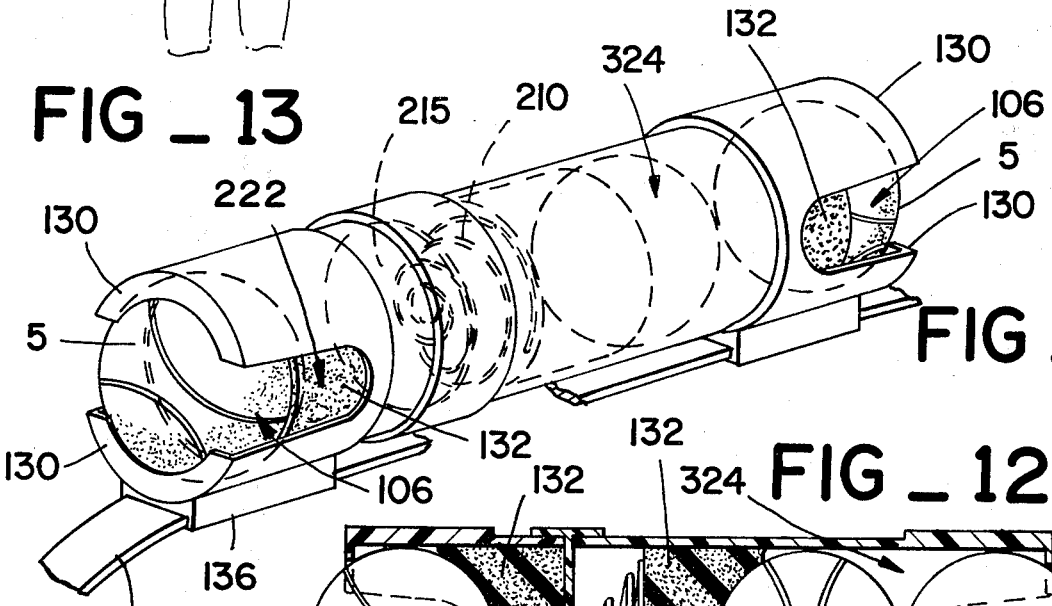
FIG. 11 is a perspective view of an embodiment suitable for carrying three balls.
Figure 12:
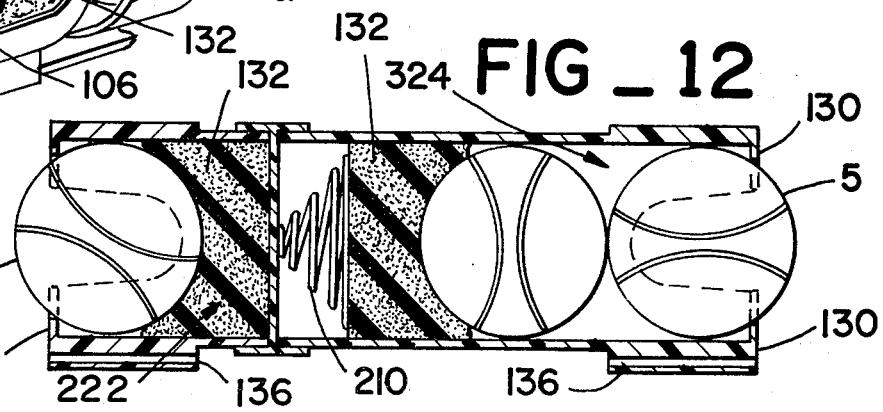
FIG. 12 is a cross-sectional view of the embodiment of FIG. 11.

FIGS. 11 and 12 show a still further embodiment of the invention, comprising a generally tubular structure having two open chambers 222 and 324. The features of the embodiment of FIGS. 11 and 12 correspond in all aspects to the features of the embodiment of FIGS. 9 and 10, except as follows: The chamber 324 is of a size sufficient to accommodate at least two standard tennis balls in tandem. A compressible coil spring 210 is provided which is anchored to the partition 215 and is operative to support the confronting foam pad 132. The spring 210 is sufficiently compressible to permit insertion of at least two standard tennis balls in the chamber 324, and it is sufficiently resilient to maintain at least one tennis ball in releasably snug hold between the foam pad 132 and the lips 130 during player movement.

Figure 13:
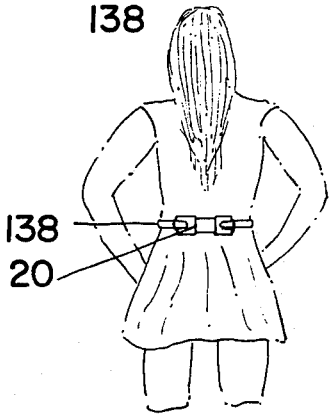
FIG. 13 is a back view of a person wearing an embodiment of the invention about the torso.

FIG. 13 depicts a preferred positioning of the tube 20 on the person of a player. The tube 20 may be belted or harnessed to the torso of a player so that the axis of the tube 20 is approximately horizontal. It may preferably be positioned on the user's back or in any other position as may be comfortable. For example, the device may be slung over a shoulder, harnessed to an upper arm or strapped to a thigh or angle. In case the device is to be harnessed to an extremity, it may be preferable that the belt loops be aligned so that the tube 20 is parallel to the extremity.

The above provides a full and complete disclosure of the preferred embodiment of the invention. Various modifications, alternate constructions, and equivalents may be employed without departing from the true spirit and scope of the invention. Therefore, the above description and illustration should not be construed as limiting the scope of the invention defined by the appended claims.

What is claimed is:

1. A carrier adapted to be attached to the person of a tennis player for temporarily enclosing at least one tennis ball, comprising: a generally rigid cylinder terminating in at least one open end, said open end having a pair of diametrically generally rigid protrusions each extending inwardly about a portion of the circumference of said cylinder to define a chamber with a circular opening therefrom less than the diameter of a tennis ball; a pair of diametrically opposed slots formed between said protrusions, said slots being of less width than the diameter of a tennis ball and extending along said cylinder to a location spaced from said opening by a distance sufficient to permit digital access to the back side of an enclosed ball; means for biasing said ball against said protrusions; and means for attaching said device to the person of said player, whereby a tennis ball temporarily enclosed by said can be removed therefrom such as by said player inserting a finger and thumb through said slots against the back side of said enclosed ball with sufficient force to the surface of said ball to cause said ball to be temporarily deformed without appreciable deformation of said protrusions so as to pass in an axial direction beyond said protrusions and be free of said chamber.

2. A carrier in accordance with claim 1 and further characterized by said generally rigid protrusions being formed at about a right angle to said cylinder.

3. A ball carrier according to claim 1, wherein said biasing means comprises a laterally and axially compressible resilient foam pad disposed in said chamber adapted to confront the back side of the enclosed ball, said pad being operative to substantially conform to the confronting surface of the enclosed ball, and being sufficiently pliant to permit ready finger access to the pad-confronting side of the enclosed ball.

4. A ball carrier according to claim 3, wherein said biasing means further comprises a compressible spring disposed between said ball-confronting foam pad and the inner wall of said chamber.

5. A ball carrier according to claim 3, wherein said foam pad is disposed confronting the inner wall of said chamber.

6. A tennis ball carrier according to claim 1, wherein said attaching means includes a belt permitting a player to fasten the structure to the player's torso.

7. A tennis ball carrier according to claim 1, wherein said rigid protrusions comprise an inwardly directed rigid lip defining the minimum diameter of said mouth.

* * * * *